US006048262A

United States Patent [19]

Ray

[11] Patent Number: 6,048,262

[45] Date of Patent: Apr. 11, 2000

[54] HONING DEVICE FOR CULINARY KNIVES

[76] Inventor: Ralph Ray, 37341 Hwy. 94, Box 1515, Boulevard, Calif. 91905

[21] Appl. No.: 09/255,476

[22] Filed: Feb. 23, 1999

[51] Int. Cl.[7] ..... B24B 33/00

[52] U.S. Cl. ..... 451/555; 451/557; 451/524

[58] Field of Search ..... 451/524, 555, 451/556, 557, 558

[56] References Cited

U.S. PATENT DOCUMENTS

| | | | |
|---|---|---|---|
| 678,301 | 7/1901 | Lucas | 451/557 |
| 953,445 | 3/1910 | Stephan | 451/555 |
| 1,006,986 | 10/1911 | Strickland | 451/557 |
| 1,158,048 | 10/1915 | Hawks | 76/88 |
| 1,352,888 | 9/1920 | Gallagher | 451/557 |
| 2,380,539 | 7/1945 | Miller | 51/205 |
| 2,804,732 | 9/1957 | Brockley | 51/205 |
| 4,094,106 | 6/1978 | Harris | 51/214 |
| 4,197,677 | 4/1980 | Graves | 51/214 |
| 5,046,385 | 9/1991 | Cozzini et al. | 76/89.2 |
| 5,163,251 | 11/1992 | Lee | 51/214 |

*Primary Examiner*—Timothy V. Eley
*Assistant Examiner*—Dung Van Nguyen
*Attorney, Agent, or Firm*—Charles C. Logan, II

[57] ABSTRACT

A honing device for culinary knives having a handle assembly formed of a knob portion mounted on the top end of a vertically oriented handle portion. An inverted frusto-conical knife guide is connected to the bottom end of the handle portion. The elongated hone is preferably tubular and it is connected to the bottom end of the knife guide. A coupling inserted into the bottom end of the tubular hone has a rubber friction tip mounted on its bottom end. An elongated draw bar rod has external threads on its top and bottom end. The top end of the draw bar rod passes through aligned bores in the knife guide and the handle portion and is received in a threaded bore in the bottom of the knob portion. The bottom end of the draw bar rod is received in the threaded bore in the top end of the coupling that has a rubber tip in its respective bottom end. The honing device is light weight and easily assembled and disassembled.

4 Claims, 1 Drawing Sheet

HONING DEVICE FOR CULINARY KNIVES

BACKGROUND OF THE INVENTION

The invention relates to a honing device and more specifically to a hand held hone having a knife guide which will establish the required angle that a culinary knife is to be sharpened.

In order to keep a premium fine edged knife in carving condition, its edge should be honed with a few strokes on a sharpening steel before each use. The proper technique isn't difficult but it does require practice. For the inexperienced user, it is often difficult to orient the bottom edge of the knife at a 20 degree angle, which is the half-angle of the bottom edge of the knife.

It has been known for years that the proper tool for sharpening "chef's knives" is to use a chef's steel. These honing devices include an elongated narrow cylindrical rod of steel sharpening material and a concentric handle at the top end of the rod with a guard between the handle and the sharpening rod to insure that the user doesn't accidently cut themselves with the knife during the sharpening process.

To sharpen high carbon steel knives with this "chef's steel", the knife is to be drawn over one edge of the sharpener at approximately a 20 degree angle on one side and then on the other side of the knife at approximately 20 degree angle. No means other than what the operator conceives to be a 15 to 20 degree angle was provided. Therefore, the effectiveness of the sharpening varied from operator to operator. A chef would not allow an apprentice to sharpen his knives because it would affect the efficiency of the knives if they were to sharpen them at an angle other than the customary approximately 20 degree angle.

The cutting edge of a fine quality high carbon stainless steel knife has a very fine edge that curls. It curls when you cut and it curls when moisture is introduced. It also curls at random on the left side of the blade and the right side of the blade. With the chef's steel, you rub or burnish against the hard surface of the cutting edge for the purpose of straightening it back out so that it is the same way as when it was manufactured. Five or six strokes on each side was commonly needed to sharpen the knife due to the user's inability to properly align the knife edge at the proper angle to the "steel".

To overcome these deficiencies in the prior art, blade sharpeners such as that of the Graves U.S. Pat. No. 4,197,677 has been designed with guide-guards attached to the opposite ends of an elongated cylindrical sharpening rod. A handle extends outwardly from one of the guide-guards. This blade sharpener has been designed to be used in a horizontal manner.

Another prior art "chef's steel" is disclosed in the Harris U.S. Pat. No. 4,094,106. This honing device has been designed to be used in a vertical position and it has a conical blade guide adjacent the top end of the steel to establish an appropriate angle at which to hold the knife for sharpening.

The prior art sharpening steels still have problems that annoy their users. The horizontal sharpener of Graves has not been very well received. The "chef's steels" that are used in a vertical manner require the use of a hand shake grip and the bottom end of the steel has a tendency to slip or shoot outwardly at times during use. These prior art "chef steels" are also quite heavy.

It is an object of the invention to provide a novel sharpening steel whose weight is greatly reduced from that of the prior art sharpening steels.

It is another object of the invention to provide a novel sharpening steel that has structure on the bottom end that prevents it from slipping or shooting outwardly during its use.

It is another object of the invention to provide a novel sharpening steel that has an outer surface that is as hard or harder than tool steel.

It is a further object of the invention to provide a novel sharpening steel that has the hone made of aluminum that is hard anodized on its outer surface.

It is a further object of the invention to provide a novel sharpening steel that has a knob portion at the top of its handle assembly that allows its user to cup the palm of the hand over it.

It is another object of the invention to provide a novel sharpening steel made of several parts that are easily assembled and disassembled.

SUMMARY OF THE INVENTION

The novel honing device for culinary knives is extremely lightweight due to the use in a preferred embodiment of tubular aluminum stock whose outer surface has been hard anodized. Typically the rockwell hardness will be in the range of 65 to 70 and although it is made of aluminum metal it would still be called a "steel". The process for anodizing the aluminum honing member results in a cross section showing that the anodizing material penetrates half way into the aluminum and also grows outwardly an equal thickness.

The Culinary Institute of America teaches as one of the methods of sharpening culinary knives the use of a vertically oriented "steel".

The features of the inventor's honing device that significantly assists the person using it include the knife angle guide and it's novel handle assembly. The knob at the top end of the handle assembly allows the user to use a palm grip which gets the wrist and hand out of the way so that you can see what you are doing. It is a natural grip because the user can relax and it does not require any force other than the weight of a person's hand. This allows the user to see and burnish both sides of the knife. The friction tip on the bottom end of the honing device prevents it from slipping or sliding outwardly during the sharpening operation. The use of a hollow hone made of aluminum significantly reduces its weight. Hard anodized aluminum is harder than steel. With the novel honing device two strokes on each side will pretty much sharpen the knife due to the fact that the user orients the knife blade at the proper angle to the "steel" by aligning the blade with the knife guide.

DESCRIPTION OF THE PREFERRED EMBODIMENT

Figure 1:
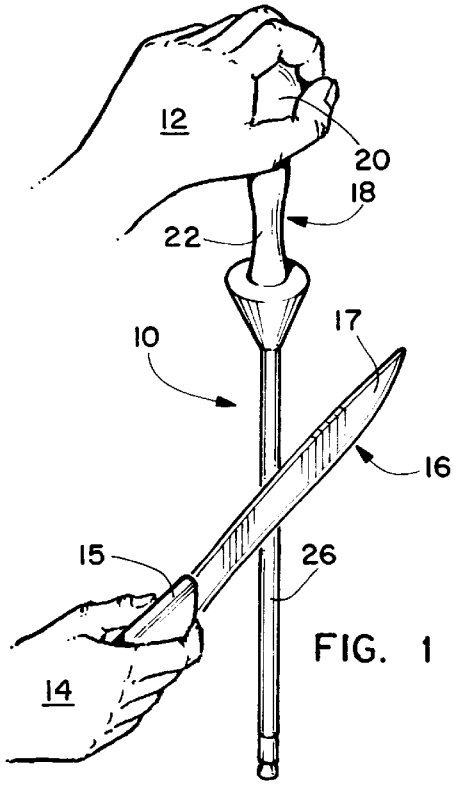
FIG. 1 is a front perspective view illustrating the manner in which the novel honing device is used.
Figure 3:
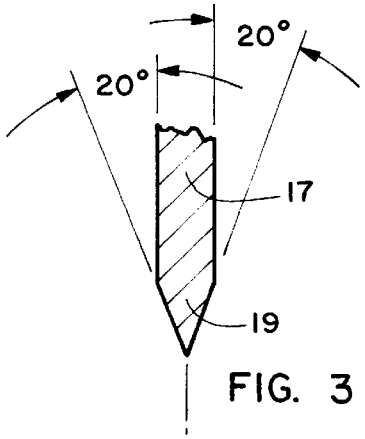
FIG. 3 is a partial vertical cross sectional view of the bottom edge of a high carbon steel culinary knife.

The novel honing device for culinary knives will now be described by referring to FIGS. 1–5 of the drawing. The honing device is generally designated numeral 10.

A person using the honing device places a hand 12 with the palm resting on the top of knob portion 20 of handle assembly 18. The bottom end of honing device 10 is rested on a horizontal surface (not shown). The person's other hand 14 holds handle 15 of knife 16. Knife 16 has a blade 17 having a bottom edge or tip 19. Blade 17 is normally made of high carbon steel. The bottom edge or tip 19 has an all inclusive angle of 40 degrees, with 20 degrees on each side of its vertical X-axis (see FIG. 3).

Figure 2:
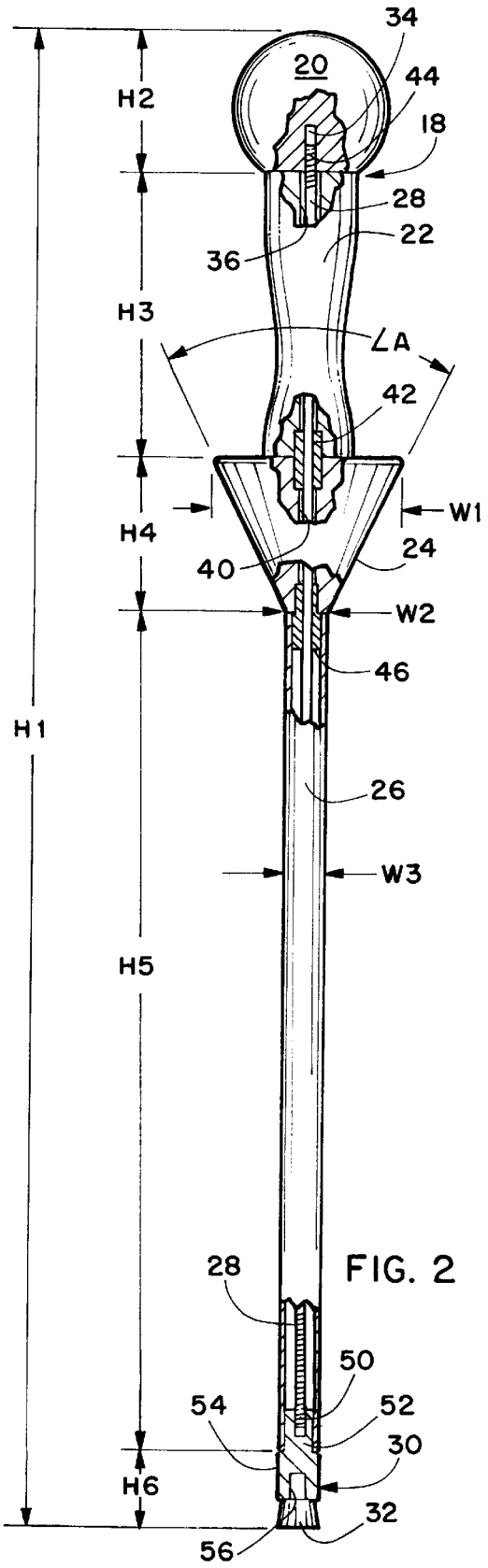
FIG. 2 is a side elevation view showing portions broken away to illustrated the interior of the honing device.

Referring to FIG. 2, honing device 10 has a height H1 in the range of 15–22 inches. It has a handle assembly 18, an inverted frusto-conical knife guide 24, a tubular hone 26, a draw bar rod 28, a coupling 30 and a rubber friction tip 32. Handle assembly has a knob portion 20 and a handle portion 22. Knob portion 20 has a height H2 in the range of 1–3 inches. It has an internally threaded bore hole 34. Handle portion 22 has height H3 in the range of 2.5–6 inches and it has a bore hole 36 passing from its top end to its bottom end. In the preferred embodiment the handle portion and knob portion would normally be made of wood or molded plastic material.

Frusto-conical knife guide 24 has a height H4 in the range of 1–3 inches. It has a width W1 at its top end and a width W2 at its bottom end. Frusto-conical knife guide 24 has an all inclusive angle A which is in the range 45–59 degrees. Frusto-conical knife guide 24 has a bore hole 40 that extends from its top end to its bottom end. A tubular sleeve 42 frictionally engages the bottom end of bore hole 36 and the top end of bore hole 40. A tubular plug 46 frictionally engages the bottom end of bore hole 40 and the top end of tubular hone 26. Draw bar rod 28 has an externally threaded top end 44 that is received in threaded bore 34 of knob portion 20.

In the preferred embodiment, tubular hone 26 is made of aluminum having a hard anodized outer surface whose rockwell hardness will be in the 65 to 75 range. Tubular hone 26 has a diameter W3 in the range of 0.375–1.25 inches. Tubular hone has a height H5 in the range of 7–13 inches.

The bottom end of draw bar rod 28 has an externally threaded tip 50 that screws into the neck portion 52 of coupling 30. Coupling 30 has a body portion 54 having a recess 56 in its bottom end that receives rubber tip 32.

Figure 4:
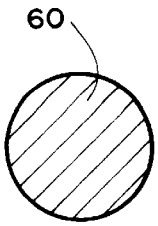
FIG. 4 is a horizontal cross sectional view of a first alternative embodiment cylindrical hone.

FIG. 4 shows a first alternative hone 60 that is made of solid cylindrical material and it would have internally threaded bore holes in its top and bottom ends to receive respective draw bar rods that would connect respectively to the handle assembly 18 and coupling 30.

Figure 5:
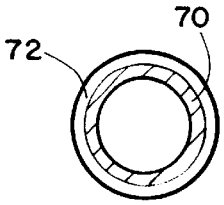
FIG. 5 is a horizontal cross sectional view of a second alternative embodiment of the hone.

A second alternative embodiment is illustrated in FIG. 5. It shows a tubular hone 70 made of metal and having its outer surface covered by a ceramic coating 72.

What is claimed is:

1. A honing device for culinary knives comprising:

a vertically oriented handle assembly having a top end and a bottom end; said handle assembly having a first bore hole extending upwardly from its bottom end; said handle assembly having a vertically oriented handle portion having a top end and a bottom end; a knob portion having a bottom end is mounted on said top end of said handle portion; said knob portion having a width greater than the width of said handle portion;

a vertically oriented frusto-conically shaped knife guide having a top end and a bottom end; said top end having a width W1 and said bottom end having a width W2 and W1 is greater than W2; a second bore hole extends upwardly from said bottom end to said top end;

a vertically oriented elongated hone having a top end, a bottom end, a height H5, a width W3 and an outer surface; said hone is tubular from its top end to its bottom end; said hone being made of hard anodized aluminum material;

means connecting said handle assembly and said knife guide to said top end of said hone comprising an elongated length of draw bar rod having a top end and a bottom end; said top end is received in said first bore hole of said handle portion and passes through said second bore hole of said knife guide; said draw bar having a length that passes downwardly through the length of said elongated hone;

a friction tip; and means connecting said friction tip to said bottom end of said hone comprising a coupling having a top end and a bottom end; said coupling having a neck portion and a body portion; said neck portion being received in said bottom end of said tubular hone; said bottom end of said draw bar rod having an externally threaded tip that screws into said top end of said neck portion; said bottom end of said coupling having a recess that receives said friction tip.

2. A honing device for culinary knives as recited in claim 1 wherein said knob portion has a height H2 in the range of 1–3 inches and said handle portion has a height H3 in the range of 2.5–6 inches.

3. A honing device for culinary knives as recited in claim 1 wherein said knife guide has a conical angle A in the range of 45–59 degrees.

4. A honing device for culinary knives as recited in claim 1 wherein said honing device has a height H1 in the range of 15–22 inches.

* * * * *